US007665275B2

(12) United States Patent
Meessen

(10) Patent No.: US 7,665,275 B2
(45) Date of Patent: Feb. 23, 2010

(54) PACKAGING SYSTEM WITH DUNNAGE DELIVERY ASSEMBLY

(75) Inventor: Hans Meessen, Wiljre (NL)

(73) Assignee: Ranpak Corp., Concord Township, OH (US)

( * ) Notice: Subject to any disclaimer, the term of this patent is extended or adjusted under 35 U.S.C. 154(b) by 172 days.

(21) Appl. No.: 11/815,610

(22) PCT Filed: Feb. 21, 2006

(86) PCT No.: PCT/US2006/006362

§ 371 (c)(1),
(2), (4) Date: Aug. 6, 2007

(87) PCT Pub. No.: WO2006/089306

PCT Pub. Date: Aug. 24, 2006

(65) Prior Publication Data

US 2008/0307756 A1 Dec. 18, 2008

Related U.S. Application Data

(60) Provisional application No. 60/654,198, filed on Feb. 18, 2005.

(51) Int. Cl.
*B65B 5/00* (2006.01)

(52) U.S. Cl. ..... 53/247; 53/473; 53/255; 493/967; 493/464

(58) Field of Classification Search ..... 53/247, 53/473, 472, 255; 493/967, 904, 464
See application file for complete search history.

(56) References Cited

U.S. PATENT DOCUMENTS 4,008,796 A * 2/1977 Aylon ..... 198/460.1

(Continued)

FOREIGN PATENT DOCUMENTS

NL 1015126 C1 11/2001

(Continued)

OTHER PUBLICATIONS

International Search Report of International Application No. PCT/US2006/006362, published as International Publication No. WO 2006/089306 A1, on Aug. 24, 2006.

(Continued)

*Primary Examiner*—Sameh H. Tawfik
(74) *Attorney, Agent, or Firm*—Renner, Otto, Boisselle & Sklar, LLP

(57) ABSTRACT

A packaging system (10) and method for supplying and distributing dunnage products to multiple packing stations (14, 16) is characterized by a supply of dunnage products (12), a plurality of packing stations (14, 16), and a distribution assembly (20) that selectively distributes the dunnage products from the supply (12) to selected ones of the packing stations (14, 16). The supply of dunnage (12) may include a converter (22) that converts sheet stock material into a relatively less dense dunnage product. The distribution assembly (20) includes a conveyor (40), an alignment device (50) downstream of the conveyor (40), and a tiltable dunnage product support surface (60) below the alignment device (50). The alignment device (50) controls the descent of a dunnage product therethrough to the support surface (60). The support surface (60) is tiltable to selectively direct the dunnage product toward respective packing stations (14, 16).

10 Claims, 6 Drawing Sheets

U.S. PATENT DOCUMENTS

| | | | | | |
|---|---|---|---|---|---|
| 4,717,613 | A | | 1/1988 | Ottaviano | |
| 4,922,687 | A | * | 5/1990 | Chow et al. | 53/472 |
| 5,109,799 | A | * | 5/1992 | Lader | 119/51.13 |
| 5,123,889 | A | | 6/1992 | Armington et al. | |
| 5,487,717 | A | | 1/1996 | Tekavec et al. | |
| 5,542,232 | A | | 8/1996 | Beierlorzer | |
| 5,593,376 | A | | 1/1997 | Armington et al. | |
| 5,637,071 | A | | 6/1997 | Simmons et al. | |
| 5,641,052 | A | | 6/1997 | Lazzarotti et al. | |
| 5,749,821 | A | | 5/1998 | Simmons | |
| 5,829,231 | A | * | 11/1998 | Harding et al. | 53/493 |
| 5,868,657 | A | | 2/1999 | Simmons | |
| 5,902,223 | A | | 5/1999 | Simmons | |
| 6,026,632 | A | | 2/2000 | Simmons | |
| 6,203,481 | B1 | | 3/2001 | Harding et al. | |
| 6,240,705 | B1 | | 6/2001 | Simmons, Jr. et al. | |
| 6,718,729 | B2 | * | 4/2004 | Manley | 53/247 |
| 2002/0107129 | A1 | | 8/2002 | Manley | |

FOREIGN PATENT DOCUMENTS

| | | | |
|---|---|---|---|
| WO | 96/40495 | A | 12/1996 |
| WO | 99/14033 | A | 3/1999 |

OTHER PUBLICATIONS

Specification and drawings of commonly-owned U.S. Appl. No. 60/362,827, filed Mar. 9, 2002.

* cited by examiner

PACKAGING SYSTEM WITH DUNNAGE DELIVERY ASSEMBLY

This invention claims the benefit of International Application No. PCT/US2006/006362, filed 21 Feb. 2006, published in English as International Publication No. WO 2006/089306 A1,which claims the benefit of U.S. Provisional Patent Application No. 60/654,198, filed 18 Feb. 2005, both of which are hereby incorporated herein.

FIELD OF THE INVENTION

This invention is related to the field of packaging systems, and more particularly to a packaging system with a dunnage delivery assembly.

BACKGROUND

In the process of packing an article in a container for shipping from one location to another, a dunnage product is typically placed in the container with the article. This dunnage product can be as simple as a sheet of paper or other sheet material. By converting the sheet material into a dunnage product having enhanced properties for a specific application, however, such as cushioning, blocking and bracing, or void fill, a more desirable dunnage product is produced.

A machine that converts the sheet material into a dunnage product may be referred to as a converter. Exemplary converters are disclosed in U.S. Pat. Nos. 4,717,613; 5,487,717; 5,123,889; 5,542,232; 5,593,376; 5,637,071; 5,902,223; and 6,026,632. These converters, of a type referred to as cushioning conversion machines, convert sheet stock material, such as paper in multi-ply form, into relatively lower density cushioning pads. These are not the only types of converters, of course.

Converters typically discharge dunnage products in a predetermined discharge direction through an exit to a transitional zone, such as a holding area or a staging area, from which the dunnage products may later be removed for insertion into a container for packaging purposes.

SUMMARY

The present invention provides a packaging system and method for supplying and distributing dunnage products to multiple packing stations. The invention is characterized by a supply of dunnage products, a distribution assembly and multiple packing stations combined to provide a packaging system and method that afford advantages over existing packaging arrangements.

In particular, the present invention provides a packaging system that includes a supply of dunnage products, a plurality of packing stations, and a distribution assembly that selectively distributes the dunnage products from the supply to selected ones of the packing stations. The distribution assembly includes an alignment device for receiving dunnage products in a first direction and a support surface below the alignment device. The alignment device has an inclined surface that is inclined in a second direction transverse the first direction to guide dunnage products moving through the alignment device. The dunnage support surface is tiltable to selectively direct a dunnage product toward a respective packing station.

The supply of dunnage may include a converter that converts sheet stock material into a relatively less dense dunnage product. In one embodiment, the converter is a cushioning conversion machine capable of converting kraft paper into a cushioning dunnage product.

The system may further include a controller that selectively directs elements of the distribution assembly, such as the tiltable support surface, to produce or distribute dunnage products to respective packing stations.

The present invention also contemplates a packaging method that includes the following steps: supplying dunnage products to a distribution assembly; transporting the dunnage products from the supply; guiding dunnage products to fall onto a support surface; selectively directing the dunnage products from the support surface to at least one of a plurality of packing stations; and delivering the dunnage products to the at least one selected packing station.

The supplying step includes converting a sheet stock material into a relatively lower density dunnage product. In turn, an exemplary converting step includes converting kraft paper into a cushioning dunnage product.

The directing step includes selectively tilting a dunnage support surface, and the delivering step includes depositing the dunnage products into a receptacle.

These and other features of the invention are fully described and particularly pointed out in the claims. The following description and annexed drawings set forth in detail one illustrative embodiment of the invention, this embodiment being indicative of but one of the various ways in which the principles of the invention may be employed.

DETAILED DESCRIPTION

Figure 1:
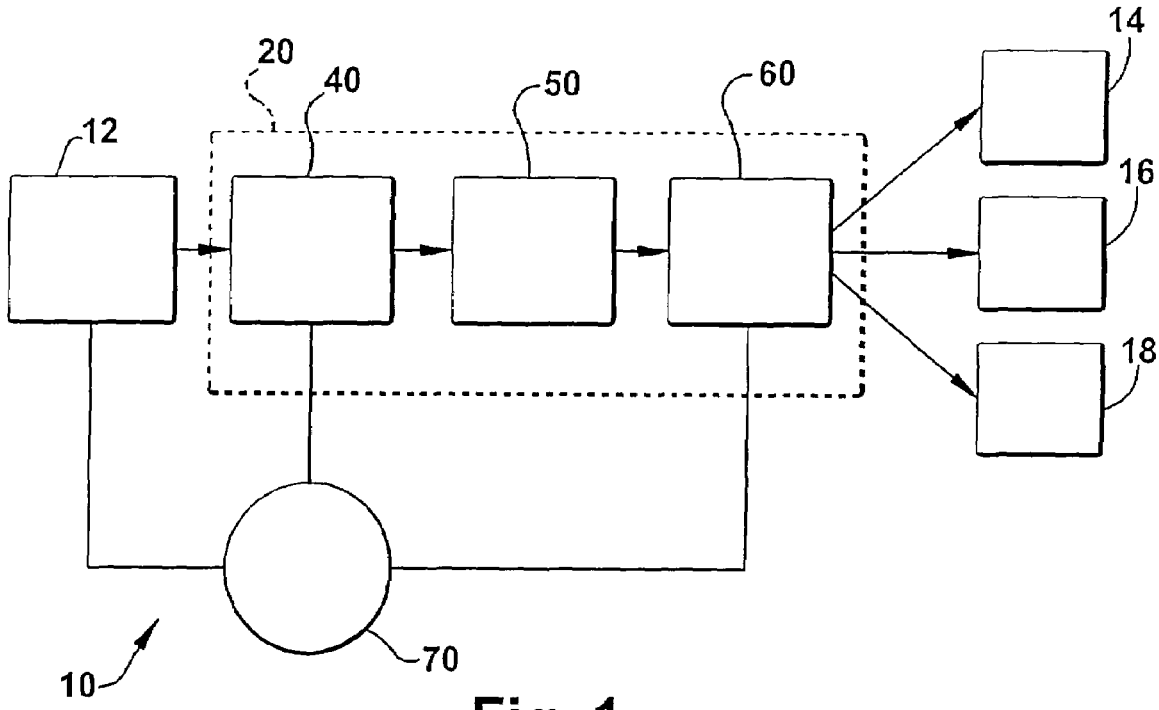
FIG. 1 is a schematic view of a system provided by the present invention.
Figure 2:
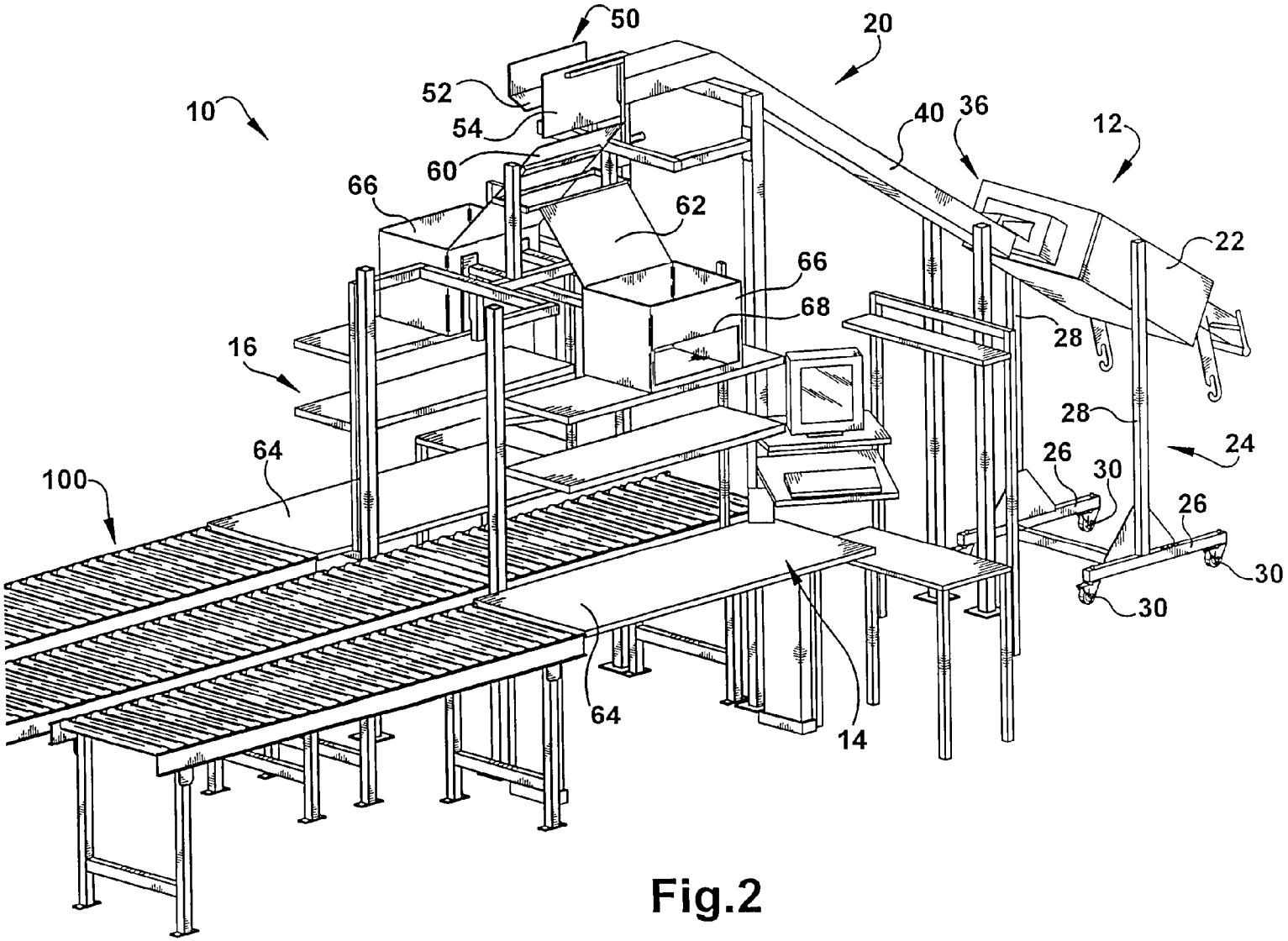
FIG. 2 is a perspective view of an exemplary system provided by the present invention.
Figure 3:
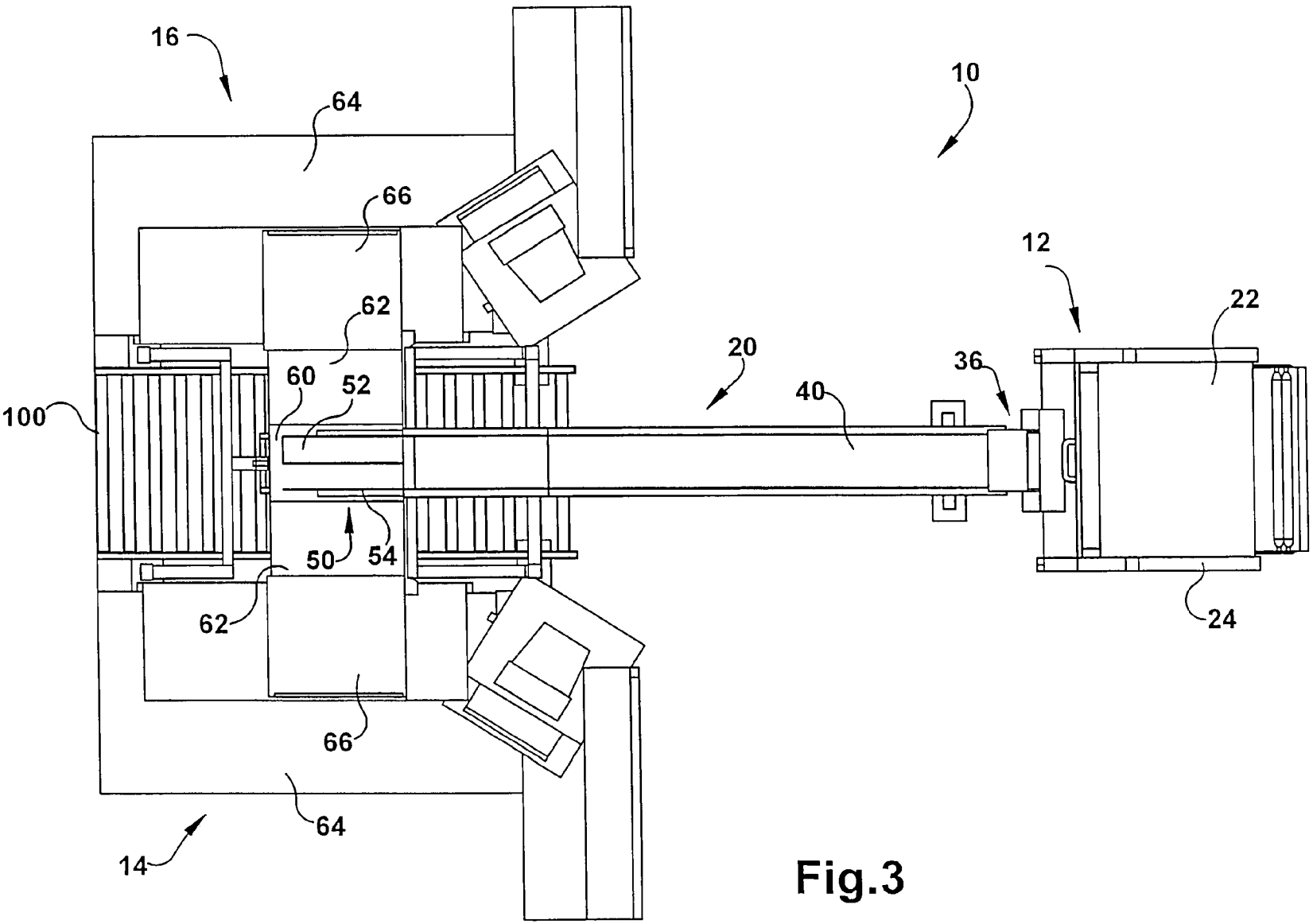
FIG. 3 is a top plan view of the system of FIG. 2.

Referring to the drawings in detail, and initially to FIG. 1, the present invention generally provides a packaging system 10 having a supply 12 of dunnage products, a plurality of packing stations 14 and 16 and 18, and a distribution assembly 20 that transports and selectively distributes dunnage products from the supply 12 to selected ones of the packing stations 14 or 16 or 18. The distribution assembly 20 includes a support surface 60 that can be controllably titled to direct a dunnage product toward a selected packing station 14 or 16 or 18. The distribution assembly 20 also can include a conveyor 40 and/or an alignment device 50, although neither is necessary. The system 10 also includes a controller 70 that selectively directs the support surface to tilt in the desired direction, as well as controlling other elements of the distribution assembly 20, to distribute dunnage products to respective packing stations 14 and 16 and 18. The controller 70 can also control the supply 12 of dunnage to produce dunnage products therefrom.

An exemplary embodiment of the packaging system 10 provided by the present invention is shown in FIGS. 2-5. Although the same reference numbers are used in these figures as in the schematic FIG. 1, the system 10 is not limited to the exemplary embodiment shown in FIGS. 2-5. The system 10 shown in FIGS. 2-5 includes a supply of dunnage 12, a plurality of packing stations 14 and 16, and a distribution assembly 20 that selectively distributes the dunnage from the supply 12 to respective packing stations 14 and 16.

The supply of dunnage 12 in the illustrated embodiment includes a dunnage converter 22, specifically a converter of a type typically referred to as a cushioning conversion machine. Cushioning conversion machines heretofore have been used to convert sheet stock material, such as paper in multi-ply form, into low density cushioning dunnage products, or pads. An exemplary stock material is kraft paper. The resulting pads typically are relatively lightweight and are relatively less dense than the stock material from which they are made.

Cushioning conversion machines of the illustrated type generally include a forming assembly through which the sheet stock material is advanced by a feed assembly. Moving the stock material through the forming assembly causes the sheet stock material to crumple and the lateral edges to turn inwardly to form a relatively low density strip of cushioning. The feed assembly typically also connects or otherwise acts on overlapped layers of crumpled stock material to maintain the strip's shape. Pads of desired lengths are severed from the strip of cushioning downstream of the forming and feeding assemblies. For further information concerning such a converter, reference may be had to commonly-owned U.S. Pat. No. 5,123,889, which is hereby incorporated herein.

The present invention is not limited to the use of paper dunnage or cushioning pads though. In alternative embodiments, different types of dunnage converters can be employed to produce other types of dunnage, including void fill, cushioning, or bracing dunnage, made from air bags, foam-filled blocks or bags, paper strips, foam peanuts, etc.

The system provided by the present invention does not have to include a converter, however. One or more converters may be housed in a remote location for producing dunnage products for the supply 12. The supply 12 in this case includes a dispenser for storing and dispensing dunnage through an exit as needed.

The dunnage pads are discharged through an exit of the illustrated cushioning conversion machine 22 lengthwise in a generally horizontal discharge direction D. The machine 22 is mounted on a frame or stand so that the pads are discharged at a convenient height.

Figure 4:
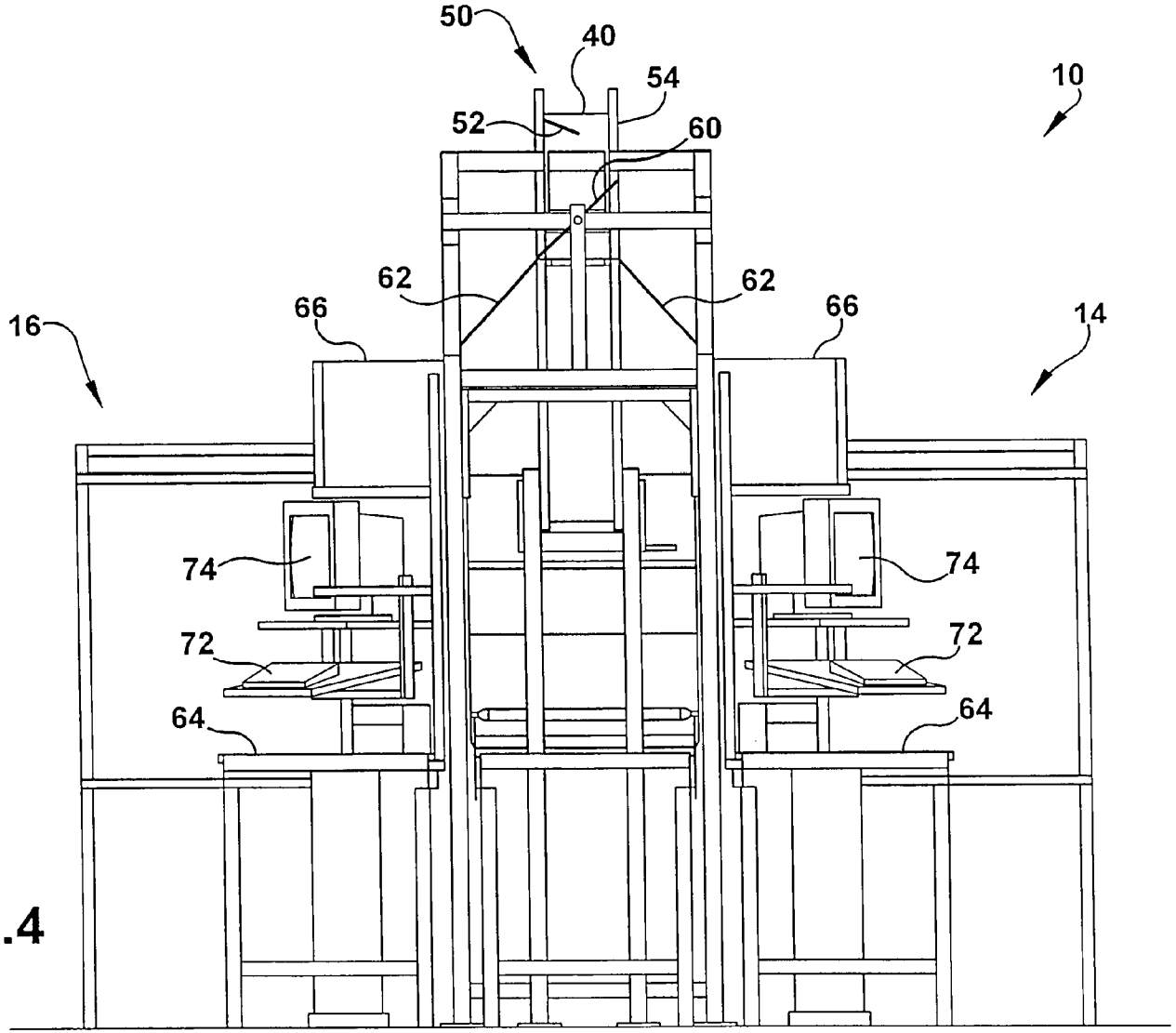
FIG. 4 is an end elevation view of the system of FIG. 2.
Figure 5:
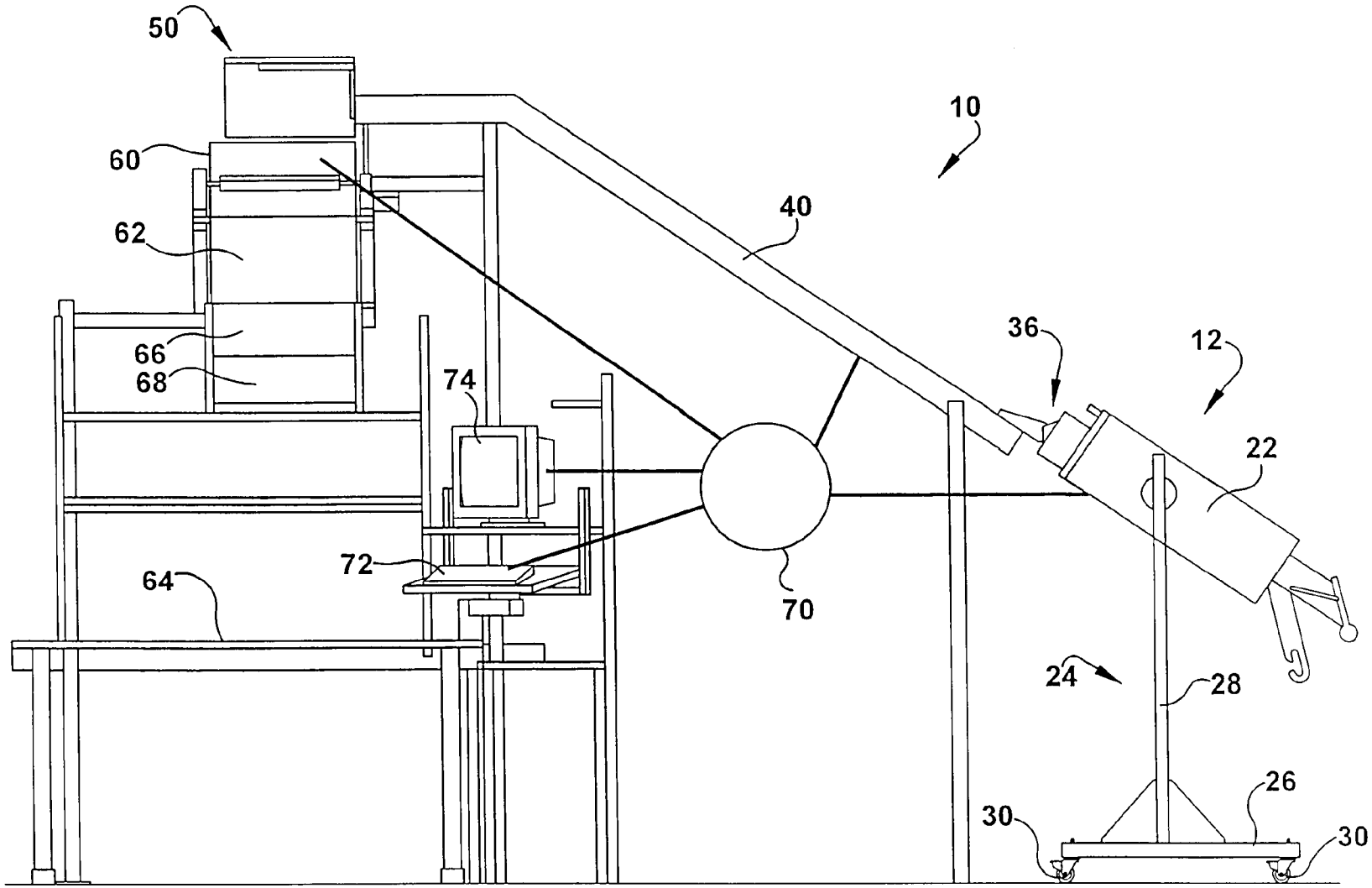
FIG. 5 is a side elevation view of the system of FIG. 2.

The illustrated converter 22 is mounted on a mobile stand 24 at an elevated position and is rotatable about a horizontal axis relative to the stand. The stand 24 has a pair of spaced apart feet 26 from which respective uprights 28 extend to support the converter. In the illustrated embodiment, each foot 26 also includes a set of wheels 30 that facilitate moving the stand 24. The wheels typically can be locked in a fixed position to keep the stand from inadvertently rolling away. The stand 24 allows the converter 22 to be moved between different orientations for different purposes. For example, the converter 22 might be moved between a generally horizontal orientation for operation, as shown in FIG. 4, for example, a more vertical orientation for loading a new source of stock material, and a generally vertical position for repositioning the converter or accessing the conversion assemblies therein for maintenance or repair. In the operating position, the exit 36 of the converter is aligned with a conveyor 40 that transports dunnage products from the converter 22 to a remote elevated position.

The conveyor 40 is part of the distribution assembly 22. The conveyor 40 can be any type of conveyor, including those shown in commonly-owned U.S. Pat. No. 5,749,821 or 5,868,657, both of which are hereby incorporated herein, and its operation can be controlled by the controller 70. Also, in some applications a pad transferring assembly may be used to frictionally engage and transfer a dunnage pad away from the dunnage conversion machine. An exemplary pad transferring assembly is shown and described in U.S. Pat. No. 5,542,232.

Cushioning pads traveling along the conveyor 40 can be deposited from the end of the conveyor, which could be acceptable in many situations. Friction between the pad and the surface onto which it is being deposited could cause the lightweight dunnage product to become misaligned, however. In addition, a cushioning product that is dropped from the end of the conveyor onto a lower surface could tumble end over end. When cushioning pads of different lengths are being produced, this can create a problem in presenting the cushioning pads in a consistent orientation on a pad support surface disposed below the end of the conveyor.

To properly align the cushioning pads, the illustrated distribution assembly 22 also includes an alignment device 50 at the end of the conveyor 40. The alignment device 50 receives the cushioning pads from the conveyor 40 and guides the pads toward a desired orientation as they pass therethrough. An exemplary alignment device is disclosed in commonly owned U.S. Provisional Patent Application No. 60/362,827, filed Mar. 8, 2002, which is hereby incorporated by reference. Such an alignment device has been used to orient pads received from a cushioning conversion machine and depositing them into a staging area immediately below the alignment device.

The illustrated alignment device 50 includes an inclined surface 52 that receives the leading end of the dunnage product. The alignment device 50 receives a cushioning pad from the conveyor 40 lengthwise, generally in a first direction, and the inclined surface 52 is inclined in a second direction transverse the first direction.

The inclined surface 52 generally is fixed in use, but may be adjustable. For example, in the illustrated embodiment the inclined surface 52 is sloped or inclined with respect to horizontal by an angle A that causes the pad to slide down the inclined surface. An exemplary angle A is about ten to seventy degrees, more preferably about ten to forty-five degrees, and preferably about twenty-five to thirty degrees. For adjustment, the inclined surface may have a hinge that provides for angular adjustments and a locking mechanism for securing the inclined surface in a fixed angular orientation. Reference may be had to U.S. Pat. No. 5,542,232 for further details concerning an exemplary inclined surface.

The leading end of a cushioning pad tends to slide down the inclined surface 52 but is restrained by the trailing portion of the pad on the conveyor 40. The spacing F between the conveyor and the top of the inclined surface 52 can help the trailing end of the pad clear the conveyor 40 without skewing. As the trailing end of the pad is released from the conveyor 40, the cushioning pad moves toward a lower edge of the inclined surface 52 and falls through an opening between the lower edge of the inclined surface 52 and an opposing generally vertical surface 54. The pad thus tends to fall sideways.

The opposing vertical surface limits the pad's lateral motion and causes the pad to fall downward to the support surface 60 therebelow. In so doing, the alignment device 50 separates and makes independent the movement of the dunnage pad in the first direction and the movement of the dunnage pad in the second direction. This controlled movement of the dunnage pad avoids problems that may arise from random movement of the dunnage pad such as, for example, the problem of the dunnage pad skewing, tilting forward or falling obliquely. Although the cushioning pads can have any length, the width of the pads is relatively uniform within a consistent range. The cushioning pads pass through the alignment device 50 and land on the support surface 60 in a consistent orientation.

The support surface 60 in the illustrated embodiment includes a flat plate. The plate is tiltable about a horizontal axis, which in the illustrated embodiment is parallel to the first direction, to discharge the cushioning pad therefrom in either of two directions toward either of the two illustrated packing stations 14 and 16. The support surface 60 typically has a coefficient of friction with respect to the cushioning pads that allows the pads to readily slide off the support surface when it is tilted. A similar tiltable support surface is disclosed in commonly owned U.S. Pat. No. 6,718,729, which is hereby incorporated herein by reference. From the support surface 60 the cushioning pads land on inclined slides 62 that guide the pads as they continue to slide toward the selected packing station 14 or 16.

Each packing station 14 and 16 includes a packing surface 64 for supporting a container, and a receptacle 66 for receiving the cushioning pad dunnage product from the tilting support surface 60. In the illustrated embodiment, the packing surface 64 is a tabletop surface, and the receptacle 66 is located at an elevated position above the tabletop.

The receptacle 66 has an opening 68 at the bottom of one side that makes it easier for a packer to retrieve cushioning pads from the receptacle 66 generally in the order in which they were delivered to the receptacle 66. This can be important in applications where dunnage products with different properties are supplied in a particular order for packing particular items. An exemplary receptacle is disclosed in commonly owned U.S. Pat. No. 6,240,705, which is hereby incorporated by reference. Other types of staging areas, such as a conveyor, can be used in place of or in addition to the illustrated receptacle 66. The receptacle 66 can be considered to be part of either the distribution assembly 20 or the packing station 14, 16.

The system 10 also includes a controller 70 (shown schematically in FIG. 4) that selectively directs elements of the distribution assembly 20 to distribute dunnage products to respective packing stations 14, 16. In association with the controller 70, the receptacle 66 can include a sensor for detecting when the receptacle is full, for example. The controller can then control the tilting support surface 60 and the supply of dunnage 12, in this case the converter 22, to supply dunnage products to the receptacle 66 until it is full or to redirect dunnage products to another packing station. Although the controller 70 generally operates without interaction from the packer, input and output devices, such as a keyboard 72 and a display 74, for example, can be provided to give the packer access to information from and provide a way to input information to the controller. As another example, in place of a sensor that tells the controller when the receptacle 66 needs additional pads, the packer could use a foot pedal to signal the controller that a packing station needs more pads, and the controller can control the needed delivery. The controller 70 thus facilitates automating much of the packaging system 10. An exemplary controller is disclosed in commonly owned U.S. Pat. No. 6,203,481, which is hereby incorporated by reference.

The illustrated system 10 also includes several conveyor lines 100 adjacent the packing surfaces 64 for transporting containers and items to be packed to and from the packing stations 14 and 16.

Figure 8:
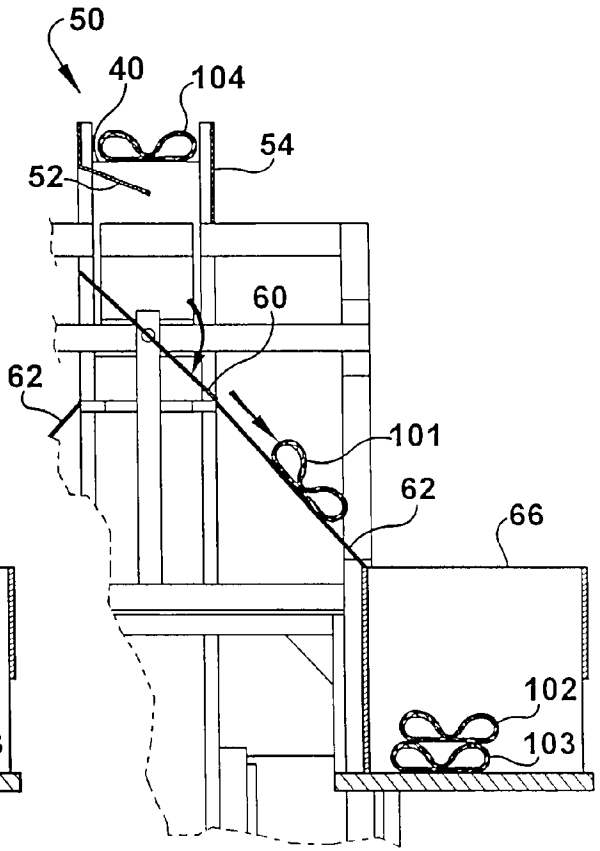
FIGS. 6-8 are schematic end elevation views of a portion of the system of FIG. 2.
Figure 7:
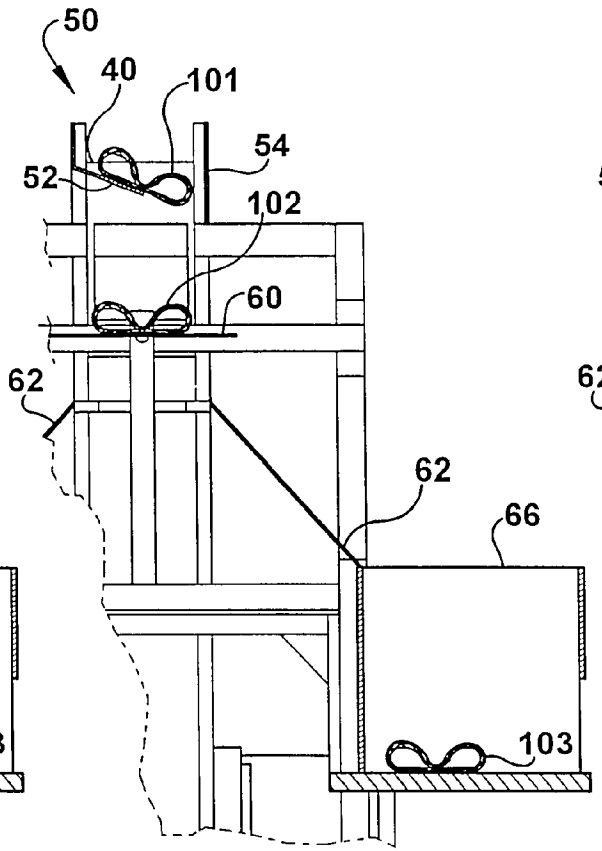
Figure 6:
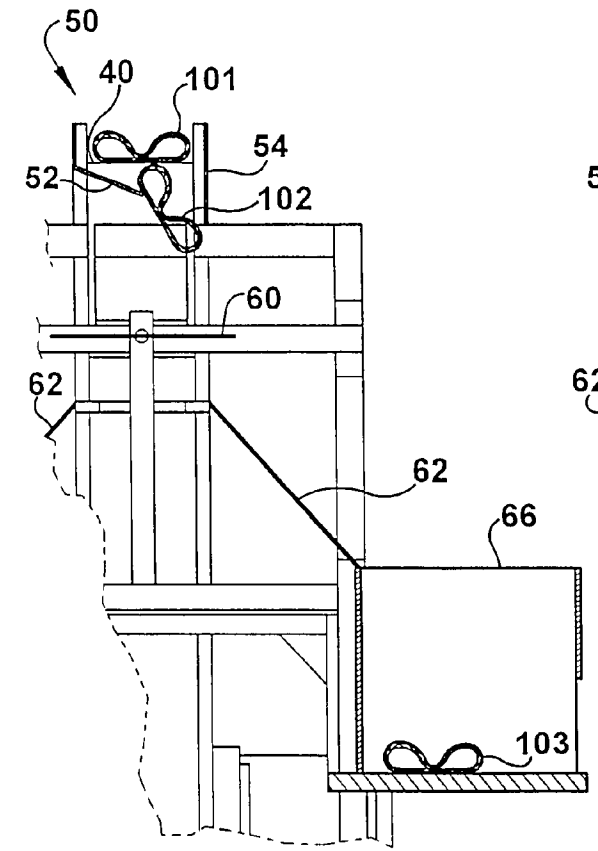

FIGS. 6-8 sequentially illustrate in greater detail the manner by which a dunnage pad is guided through the distribution assembly 20 from the conveyor 40 to the staging area at a packing station 14 or 16. In FIG. 6, a first dunnage pad 101 extends from and is supported on the conveyor 40, a second dunnage pad 102 is sliding sideways down the inclined surface 52, and a third dunnage pad 103 is stored in the receptacle 66 at the end of the slide 62. The second dunnage pad 102 slides sideways down the inclined surface 52 to fall edgewise between the distal end of the inclined surface 52 and the vertical surface 54 to fall onto the support surface 60 in a relatively horizontal orientation. The support surface 60 then tilts in the desired direction to selectively direct the pad to slid off toward a desired packing station 16. A fourth dunnage pad 104 is seen on the conveyor 40 as the first dunnage pad 101 falls from the conveyor 40 onto the inclined surface 52, from where it will fall to the support surface 60. The second dunnage pad 102 slides down the inclined slide 62 and into the receptacle 66 to join the third dunnage pad 103.

To summarize, the packaging system provided by the present invention supplies dunnage products to a distribution assembly for distribution to at least one of a plurality of packing stations. In the illustrated embodiment, the system 10 supplies dunnage products by converting sheet stock material, particularly kraft paper, into relatively lower density cushioning dunnage products. The distribution assembly 20 transports the dunnage products from the converter 22 to respective packing stations 14 and 16. Transporting the dunnage products includes at least one of transporting a dunnage product on a conveyor 40, and aligning the dunnage product as it passes through an alignment device 50. The step of directing the dunnage products includes selectively tilting a dunnage support surface 60, and the delivering step includes depositing the dunnage product into a receptacle 66 for storage until a packer retrieves it for packing an item.

Although the invention has been shown and described with respect to a certain embodiment, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment of the invention.

I claim:

1. A packaging system, comprising: a supply of dunnage products, a plurality of packing stations, and a distribution assembly that selectively distributes the dunnage products from the supply to selected ones of the packing stations; wherein the distribution assembly includes an alignment device for receiving dunnage products in a first direction and a support surface below the alignment device, the alignment device having an inclined surface that is inclined in a second direction transverse the first direction to guide dunnage products moving through the alignment device in the second direction and a substantially vertical surface laterally spaced from a distal end of the inclined surface to restrict lateral movement of a dunnage product after the dunnage product moves down the inclined surface such that the dunnage product passes between the distal end of the inclined surface and the vertical surface to fall vertically to the support surface, and the support surface being selectively tiltable from a generally horizontal orientation to discharge a dunnage product from thereon toward a selected packing station.

2. A system as set forth in claim 1, wherein the supply of dunnage includes a converter that converts sheet stock material into a relatively less dense dunnage product.

3. A system as set forth in claim 1, wherein the converter is a cushioning conversion machine capable of converting kraft paper into a cushioning dunnage product.

4. A system as set forth in claim 3, wherein at least one of the following is true: the converter is mounted for rotation relative to the stand, the converter is mounted for rotation about a substantially horizontal axis, and the stand is mobile and includes wheels.

5. A system as set forth in claim 1, wherein the converter is mounted on a stand at an elevated position.

6. A system as set forth in claim 1, wherein the distribution assembly includes a conveyor that is capable of conveying dunnage products from the supply toward a packing station.

7. A system as set forth in claim 1, wherein at least one of the packing stations includes a receptacle for receiving and storing dunnage products therein until needed.

8. A system as set forth in claim 7, wherein each packing station includes a packing surface and the receptacle is spaced above the packing surface.

9. A system as set forth in claim 7, wherein the receptacle has an opening in a side near a bottom surface of the receptacle to facilitate removing dunnage products in the order in which they are supplied to the receptacle.

10. A system as set forth in claim 1, comprising a controller that selectively directs elements of the distribution assembly to distribute dunnage products to respective packing stations.

* * * * *